US010553387B1

(12) United States Patent
Angelini

(10) Patent No.: US 10,553,387 B1
(45) Date of Patent: Feb. 4, 2020

(54) FUSE WITH ARC-SUPPRESSING HOUSING WALLS

(71) Applicant: Littelfuse, Inc., Chicago, IL (US)

(72) Inventor: Michael Angelini, Chicago, IL (US)

(73) Assignee: LITTELFUSE, INC., Chicago, IL (US)

( * ) Notice: Subject to any disclaimer, the term of this patent is extended or adjusted under 35 U.S.C. 154(b) by 0 days.

(21) Appl. No.: 16/269,819

(22) Filed: Feb. 7, 2019

(51) Int. Cl.

| | |
|---|---|
| ***H01H 85/08*** | (2006.01) |
| ***H01H 85/38*** | (2006.01) |
| ***H01H 69/02*** | (2006.01) |
| ***H01H 85/175*** | (2006.01) |
| *H01H 85/143* | (2006.01) |
| *H01H 85/12* | (2006.01) |

(52) U.S. Cl.
CPC ..... *H01H 85/38* (2013.01); *H01H 69/02* (2013.01); *H01H 85/175* (2013.01); *H01H 85/08* (2013.01); *H01H 85/12* (2013.01); *H01H 85/143* (2013.01); *H01H 2069/027* (2013.01); *H01H 2085/383* (2013.01)

(58) Field of Classification Search
CPC .. H01H 69/02; H01H 2069/027; H01H 85/08; H01H 85/12; H01H 85/143; H01H 85/175; H01H 85/38; H01H 2085/383
USPC ..... 337/187
See application file for complete search history.

(56) References Cited

U.S. PATENT DOCUMENTS

| | | | | |
|---|---|---|---|---|
| 4,894,633 | A * | 1/1990 | Holtfreter | H01H 85/0411 337/201 |
| 5,101,187 | A * | 3/1992 | Yuza | H01H 85/0417 337/255 |
| 5,229,739 | A * | 7/1993 | Oh | H01H 69/02 337/290 |
| 2012/0133478 | A1* | 5/2012 | Chiu | H01H 85/165 337/228 |
| 2016/0141140 | A1* | 5/2016 | Schmidt | H01H 69/02 337/187 |
| 2016/0217960 | A1* | 7/2016 | Abad | H01H 85/38 |
| 2018/0138004 | A1* | 5/2018 | Schlaak | H01H 85/055 |

* cited by examiner

*Primary Examiner* — Jacob R Crum

(57) ABSTRACT

Various embodiments are generally directed to providing a fuse with one or more walls for suppressing an arc during a fuse explosion and one or more methods for making the same. A fuse may include: a housing having an interior cavity and an outer cavity, a fuse element disposed within the interior cavity, a plurality of terminals extending out of the housing and electrically connected to the fuse element, and an arc-suppression wall disposed in the interior cavity that is configured to suppress an electric arc associated with the fuse element opening.

20 Claims, 7 Drawing Sheets

FUSE WITH ARC-SUPPRESSING HOUSING WALLS

FIELD OF THE DISCLOSURE

This disclosure relates generally to the field of circuit protection devices and relates more particularly to a fuse with an arc-suppressing housing.

BACKGROUND OF THE DISCLOSURE

Fuses are commonly used as circuit protection devices and are typically installed between a source of electrical power and a component in a circuit that is to be protected. A conventional fuse includes a pair of electrically conductive terminals connected to one another by a fusible element extending through an electrically insulating housing. Upon the occurrence of a fault condition, such as an overcurrent condition, the fusible element melts or otherwise separates to interrupt the flow of electrical current between the electrical power source and the protected component. The fuse thereby prevents or mitigates electrical damage to the power source and the protected component that would otherwise result if the overcurrent condition were allowed to persist.

When the fusible element of a fuse is melted or otherwise opened during an overcurrent condition, it is sometimes possible for an electrical arc to propagate between the separated portions of the fusible element. In some cases, the electrical arc may rapidly heat surrounding air and ambient particulate and may cause a small explosion within the fuse. In some cases, such an explosion may rupture the housing of a fuse and may cause damage to surrounding circuit components. It is therefore desirable to mitigate electrical arcing within fuses.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

One aspect of the present disclosure includes a fuse with at least one wall for electrical arc-suppression. The fuse includes: a first housing part having an interior cavity and an outer cavity, a fuse element disposed within the interior cavity, a plurality of terminals extending out of the first housing part and electrically connected to the fuse element, and an arc-suppression wall disposed in the interior cavity, the arc-suppression wall including a raised portion and a hollow portion, where both the raised portion and the hollow portion are configured to i) suppress an electric arc associated with the fuse element opening and ii) ultrasonically bond the first housing part to a second housing part.

Another aspect of the present disclosure includes a method for making a fuse with at least one wall for electrical arc-suppression. The method includes: providing a fuse structure that includes a fuse element and a first terminal and a second terminal connected to the fuse element, providing a first housing part and a second housing part, each of the first housing part and the second housing part including at least one arc-suppression wall, and bonding the first housing part and the second housing part by ultrasonically bonding the at least one arc-suppression wall of the first housing part to the arc-suppression wall of the second housing part.

Yet another aspect of the present disclosure includes a fuse with at least two walls for arc-suppression. The fuse includes: a first housing part having an interior cavity and at least one outer cavity, a fuse element disposed within the interior cavity, a plurality of terminals extending out of the first housing part and electrically connected to the fuse element, and at least two arc-suppression walls disposed in the interior cavity, each of the arc-suppression walls including a raised portion and a hollow portion where both the raised portion and the hollow portion are configured to i) suppress an electric arc associated with the fuse element opening and ii) ultrasonically bond the first housing part to a second housing part.

DETAILED DESCRIPTION

In general, the present disclosure provides a fuse having a housing disposed around a fuse element. The housing may include one or more arc-suppression walls disposed adjacent the fuse element and dividing the interior of the housing into multiple compartments. In various embodiments, the arc-suppression walls may offer advantages with regard to both manufacturing and operation of the fuse. For example, during vaporization of the fuse element, the arc-suppression walls may substantially mitigate the effects of an electrical arc associated with fuse vaporization. Moreover, the arc-suppression walls may be configured to enhance bonding of portions of the housing during manufacture of the fuse, which may improve the fuse's performance, in addition to streamlining the manufacturing process. As such, in various embodiments, fuses according to the present disclosure may be provided having high insulation resistance (e.g., >1 MΩ at 70V for a 48V fuse, or the like) after melting of the fuse element. The insulation resistance value given above is provided by way of example only and is not intended to be limiting.

Figure 1:
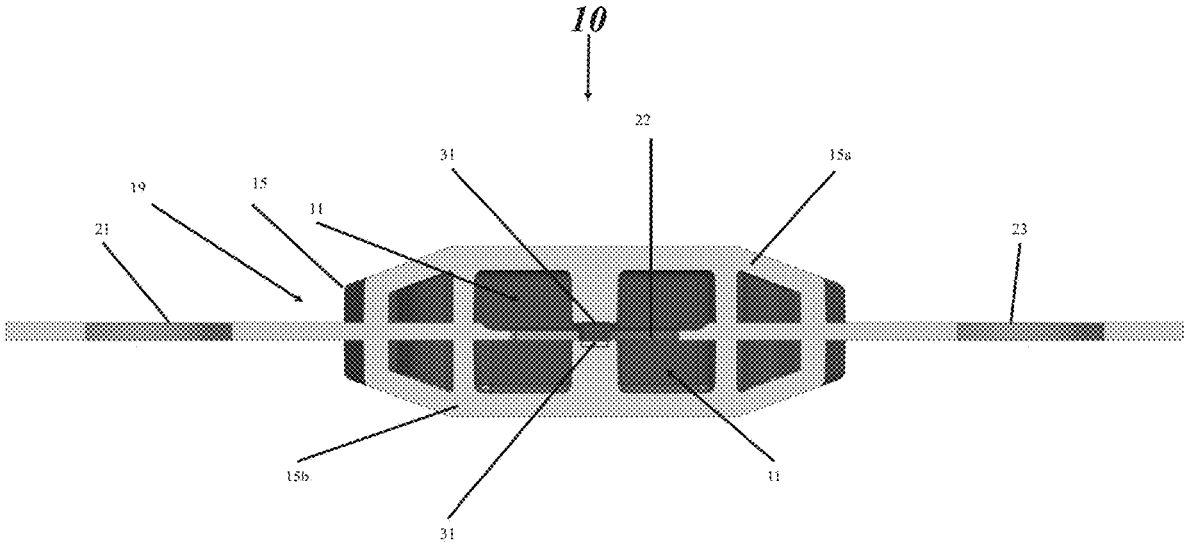
FIG. 1 is a schematic diagram illustrating a cut-away view of a fuse with an arc-suppression wall according to embodiments of the present disclosure.

FIG. 1 is a schematic diagram illustrating a cut-away view of a fuse 10 according to a non-limiting embodiment of the present disclosure. As depicted, the fuse 10 may include a housing 15 (hereinafter referred to as the "housing 15" or the "overall housing 15") that may include two or more interconnected housing parts 15*a* and 15*b*, a conductor 19 extending through the housing 15, and at least one arc-suppression wall 31 associated with each housing part 15*a* and 15*b*. In general, the conductor 19 may be made from any of a variety of conductive materials (e.g., copper, tin, silver, zinc, aluminum, alloys including such materials, or some combination of these).

The conductor 19 may include a terminal 21 and a terminal 23 connected by a fuse element 22. The terminals 21, 23 may be configured to electrically connect the fuse 10 within a circuit (e.g., between a source of electrical power and a circuit component to be protected). In some examples, the terminals 21, 23 and the fuse element 22 may be made from the same conductive material (e.g., stamped or cut from a single piece of metal). Alternatively, the terminals 21, 23 and the fuse element 22 may be made from different materials and may be joined together using any of a variety of techniques (e.g., soldering, welding, or the like).

As depicted, the housing parts 15*a* and 15*b* may define an interior cavity 11 within which the fuse element 22 is contained. The terminals 21, 23 may extend through opposing ends of the housing 15. In general, the housing 15, includes one or more arc-suppression walls 31, which may be made from any of a variety of electrically-insulating materials (e.g., plastic, ceramic, composite, epoxy, or the like). In some examples, the housing 15 may be formed around the conductor 19 and the one or more arc-suppression walls 31, such as via overmolding or similar processes. In some examples, the housing 15 may be a multi-part structure (e.g., as shown in FIGS. 2 and 3) and the fuse 10 may be assembled by connecting the housing parts (e.g. 15*a* and 15*b*) together using one or more alignment portions 13, where each housing part may define one or more of the arc-suppression walls 31.

In various embodiments, (as shown in more detail in FIGS. 2-4A) the one or more arc-suppression walls 31 directly contact the fuse element 22 on at least two points, and extend through the entire vertical length of the interior cavity 11. In various embodiments, in addition to being a physical part or portion of each housing part 15*a* and 15*b* and defining the interior cavity 11, the one or more arc-suppression walls 31 are parallel in the vertical direction with respect to all other portions of each housing part 15*a* and 15*b*, forming a connection solely with a portion or portions of the fuse element 22 and with at least one other arc-suppression wall 31, e.g. one arc-suppression wall 31 of housing part 15*a* forming a connection with an arc-suppression wall 31 of housing part 15*b*.

Figure 2:
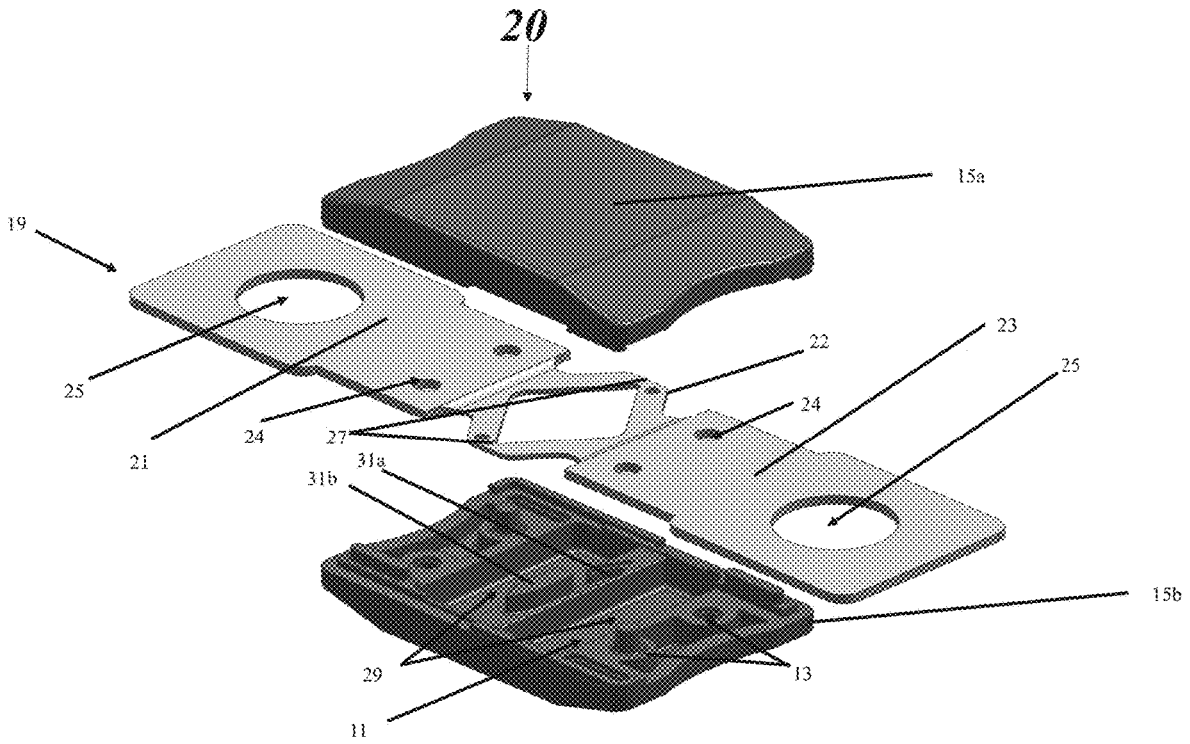
FIG. 2 is an exploded perspective view illustrating an example of the fuse of FIG. 1 according to embodiments of the present disclosure.
Figure 3:
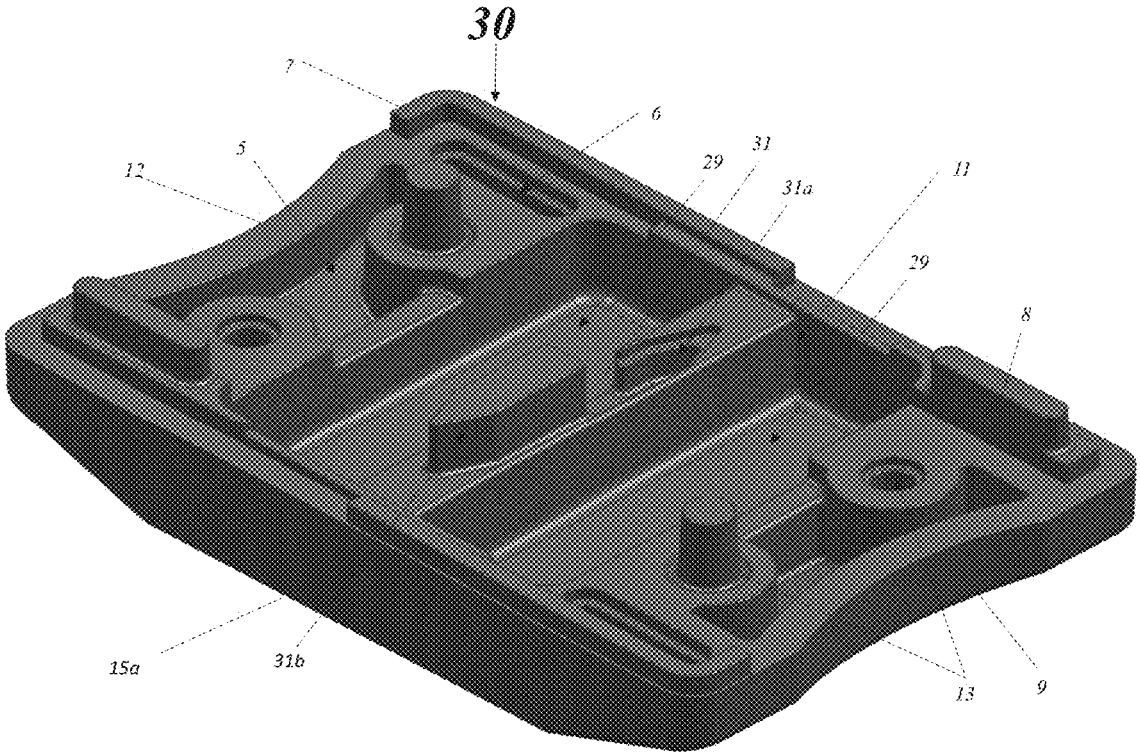
FIG. 3 is perspective view illustrating a part or portion of a housing of the fuse of FIG. 1 according to embodiments of the present disclosure.

FIG. 2 illustrates an exploded view 20 of the fuse 10 according to various non-limiting embodiments of the present disclosure. In various embodiments, the entirety of the conductor 19 will be contained in between housing parts 15*a* and 15*b* with the fuse element 22 contained in each interior cavity portion 29 of the interior cavity 11 divided by the one or more arc-suppression walls 31, with terminals 21 and 23 extending through and outside of the overall housing 15 formed by housing parts 15*a* and 15*b*. In various embodiments, as shown, the one or more arc-suppression walls 31 extend from an interior surface of the interior cavity 11 and divide the interior cavity 11 into two portions 29 along a vertical direction of the housing parts 15*a* and 15*b*. In various embodiments, the fuse element 22, which is contained in the partitioned portions 29 of interior cavity 11, forms a contiguous connection with conductor 19 and terminals 21 and 23, where terminals 21 and 23 are thicker than fuse element 22 and extend outside the housing 15. In various embodiments, and as shown in more detail in FIG. 4A, each interior cavity portion 29 contains a point of contact between the fusible element 22 and the one or more arc-suppression walls 31, where each point of contact corresponds to a terminal point of the one or more arc-suppression walls 31 in the vertical direction, and where each point corresponds to an area where the fusible element 22 may melt during a fault condition associated with operation of the fuse 10 in relation to an overall circuit connection. In various embodiments, the one or more arc-suppression walls 31 are substantially centered in relation to both interior cavity portions 29, with each of the one or more arc-suppression walls 31 forming a contiguous connection from one terminal boundary point of the interior cavity 11 to another terminal boundary point of the interior cavity 11.

In various embodiments, the terminal 21 and terminal 23 may have containment holes 25. The containment holes 25 may be configured to physically and electrically connect the fuse 10 to a source of power and circuit component. For example, the containment holes 25 may be configured so the fuse 10 may be secured to bolts or posts. Furthermore, the conductor 19 may have alignment holes 24. The alignment holes 24 may be configured to align with the alignment portions 13 of the housing part 15*a* and housing part 15*b* as the fuse 10 is assembled. The alignment holes 24 and alignment portions 13 may then retain the housing 15 (combined parts 15*a* and 15*b*) over the fuse element 22 once the fuse 10 is assembled. Additionally, the alignment portions 13, when passed through the alignment holes 24 may also align with the one or more arc-suppression walls 31 of each housing part 15*a* and 15*b*, such that a raised portion 31*b* of an arc-suppression wall 31 of one housing part 15*a* matches a hollow portion 31*a* of an arc-suppression wall of the other housing part 15*b* and vice versa. After the elements as discussed in the immediately preceded sentence are aligned, they may be ultrasonically bonded as discussed below.

In various embodiments, as stated and implied above, the one or more arc-suppression walls 31 will be formed of the same material as the housing 15 (or the housing parts 15*a* and 15*b*) and may be integral, contiguous portions of the housing 15. In various embodiments, as stated and implied above, each housing part 15*a* and 15*b* may be made from any suitable plastic material, and since the one or more arc-suppression walls 31 (including the raised 31*a* and hollow portion 31*b*) may be a feature or physical part of each (plastic) housing part 15*a* and 15*b*, the one or more arc-suppression walls 31 may be made through a single injection molding operation.

In various embodiments, the two housing parts 15*a* and 15*b* may be ultrasonically welded together with the fuse element 22 in between them. In various embodiments, other protruding features of the housing part 15*a* (discussed in greater detail in FIG. 3), in addition to the arc-suppression wall 31, such as the alignment portions 13, may each align to a recessed feature on the other housing part 15*b* when each is placed on top of the other. In various embodiments, each recessed feature has a shallow impression that is wider than its corresponding protruding feature, e.g. the hollow portion 31*b* of an arc-suppression wall 31 of one housing part 15*a* is wider than the raised portion 31*a* of an arc-suppression wall 31 of another housing part 15*b* (the two forming the housing 15), and a deeper impression inside it which is narrower than the corresponding protruding feature. In various embodiments, the hollow portion 31*b* of one housing part 15*a* matches and is paired with the raised portion 31*a* of the other housing part 15*a*, and visa-versa. In various embodiments, the shallow impression allows for alignment of the housing halves or parts 15*a* and 15*b* prior to welding. Thereafter, the housing parts 15*a* and 15*b* may be ultrasonically welded together, where one housing part 15*a* is held stationary while the other 15*b* (or vice versa) is vibrated at a high frequency. In various embodiments, the friction created from this vibration causes the plastic on each housing part 15*a* and 15*b* to melt at the locations where there is interference therebetween. As the plastic melts, pressure may be applied to the vibrating part, e.g. 15*a*, until the two housing parts 15*a* and 15*b* contain the fuse element 22 therebetween, where the pressure is applied for a suitable duration until the housing parts 15*a* solidify to form a (complete) overall housing 15.

In various embodiments, the ultrasonic welding process may aid in streamlining the manufacturing process of the fuse 10 since the housing parts 15*a* and 15*b* and their respective arc-suppression walls 31 may be formed (e.g., molded or welded) together in a single step. Moreover, in various embodiments, the ultrasonic bonding assists in making a mechanically superior overall housing 15, and improves the ability of the one or more arc-suppression walls 31 to suppress an electrical arc (as discussed in further detail below), in addition to ensuring that substantially all or as much as desired of the particulate or vaporized matter from or associated with the fuse element 22 (when melted) is caught in the relevant portions of the fuse 10, thus ensuring that circuit elements connected to the fuse remain intact and operational when vaporization occurs.

FIG. 3 illustrates a perspective view 30 of the housing part 15*a* in isolation, where housing part 15*a* and housing part 15*b* in combination form overall housing 15. It will be understood that, in various embodiments, the housing part 15*b* is substantially identical to the housing part 15*a*, and that the following description of the housing part 15*a* shall therefore also apply to the housing part 15*b*.

As shown in FIG. 3 and as stated elsewhere, the housing part 15*a* defines an interior cavity 11, within which the one or more arc-suppression walls 31 may be disposed. The one or more arc-suppression walls 31 may be formed as contiguous, integral portions of, or may be attached to, the housing part 15*a* and may divide the interior cavity 11 into two or more distinct parts or portions 29, where the fuse element 22, as noted above with reference to FIG. 2 and below with reference to FIG. 4A and FIG. 4B, will extend through both portions 29 of the interior cavity 11 and contact the arc-suppression wall 31 on at least two points. In various embodiments, the interior cavity 11 may be an open space or spaces within the fuse 10 to provide relief for arcing pressure and to collect particulate matter after the fuse element 22 has blown to mitigate rupturing of the housing 15. Similarly, in various embodiments, the housing part 15*a* may define an outer cavity 5, where the outer cavity 5 is an open space within the ends of housing 15, prior to the recessed parts 12 discussed below, where the outer cavity allows relief for arcing pressure and collects any particulate matter or molten fuse element material after the fuse has blown. In various embodiments, to further prevent fuse element 22 debris after the element 22 has blown, the housing part 15*a* may include an outer containment wall 7 at a terminal and lateral point of the housing part 15*a* that is perpendicular to the one or more arc-suppression walls 31 (and by extension the fuse element 22 and the entirety of conductor 19), and raised at a higher level in relation to all other portions of the housing part 15*a*, (with the exception of the weld tongue described below). In various embodiments, the outer containment wall 7 may collect particulate matter from burst fuse element 22 after the fuse element 22 has blown and assist with alignment during a bonding or welding process (which was discussed above) by pairing with a hollow portion of a periphery of another housing part 15*b*.

Furthermore, in various embodiments, the housing part 15*a* may include recessed parts 12 at a terminal part or parts of the housing part 15*a* in the horizontal direction and perpendicular to the one or more arc-suppression walls 31 (and by extension fuse element 22), and forming a final point of contact for the contiguous connection of conductor 19 and fusible element 22 as terminals 21 and 23 of the contiguous connection extend outside of the housing part 15*a*. The recessed parts 12 are voids that may be configured to allow the terminals 21, 23 to pass through the housing 15 when the housing 15 is assembled from housing parts 15*a* and 15*b*. More specifically, in various embodiments, when the housing part 15*a* is assembled with another housing part 15*b* to form overall housing 15, the recessed parts 12 may allow the terminals 21, 23 to extend out of the housing 15 to facilitate electrical connection of the fuse 10 to a power source and circuit component. In one or more embodiments, the housing part 15*a* may include one or more terminal interface surfaces 9, where the terminal interface surfaces 9 may be flat surfaces on each housing part 15*a* and 15*b* that can mate with a fuse element terminal 21, 23 and provide a more secure containment of the fuse element 22 in between each housing part 15*a* and 15*b*, and where in various embodiments, the terminal interface surfaces 9 are perpendicular to the fuse element 22, and form a contiguous connection with the recessed parts 12.

In various embodiments, as discussed with respect to FIG. 2, at least one of the housing parts 15*a*, 15*b* may include an alignment component configured to couple to the other housing part 15*a*, 15*b*. For example, the housing part 15*a* may include alignment portions 13, which may include one or more protrusions, ridges, cavities, or other surface features extending from the housing part 15*a*, and adapted to mate with, attach to, or abut complementary portions in housing part 15*b*. In various embodiments, the alignment portions 13 of the housing parts 15*a* and 15*b* are configured to align and mate with one another (e.g., when the housing part 15*a* is connected to the housing part 15*a* and the housing part 15*b*) through alignment holes 24 that are part of the conductor 19, and as such part of an overall connection to the fusible element 22. The alignment portions 13 may be configured to mate with one another in a snap fit relationship or the like and may provide space therebetween for epoxy or other adhesive to further secure the housing parts 15*a* and 15*b* together. In some examples, the alignment portions 13 may be complementary posts and holes (e.g., as shown in FIG. 3). In other examples, the alignment portions 13 may be rectangular or polygonal shaped protrusions with corresponding slots or receiving holes.

In various embodiments, the housing parts 15*a* and/or 15*b* may include an ultrasonic weld tongue 8 on a terminal point of the housing part 15*a* and in contact with the interior cavity portion 29, where the weld tongue 8 provides an additional contact point(s) for housing part 15*a* to bond to a weld groove 6 of an opposing housing halve, e.g. 15*b*, where the weld groove 6 is on an opposite side of the housing part 15*a* and/or 15, parallel to the outer containment wall 7, and perpendicular to the fuse element 22 and conductor 19. In various embodiments, the weld tongue also 8 provides channels to assist in properly positioning fuse element terminals 21 and 23 and to support mechanical loads associated therewith.

Figure 4A:
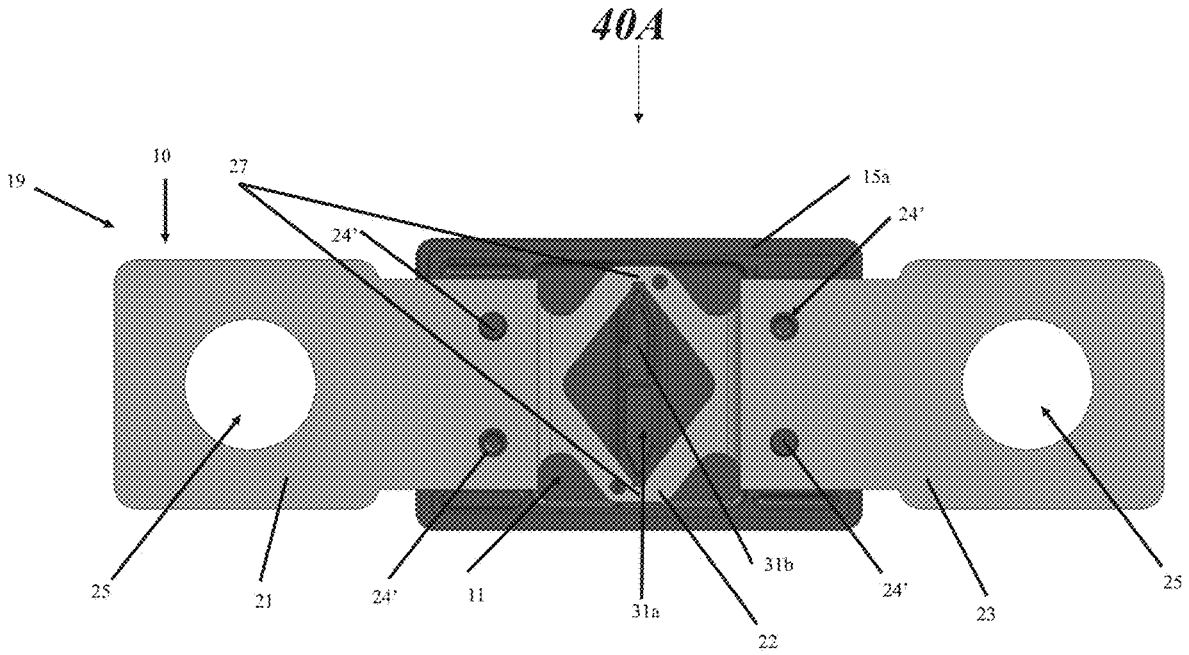
FIGS. 4A-4B illustrate a side or lateral view of a portion of the fuse of FIG. 1 before and after a fuse element of the fuse melts according to embodiments of the present disclosure.

In various embodiments, the fuse element 22, which is contained in the portioned portions (formed by the one or more arc-suppression walls 31) of interior cavity, 11 forms a contiguous connection with conductor 19 and terminals 21 and 23, where terminals 21 and 23 are thicker than fuse element 22 and extend outside the housing 15, and where the fuse element contacts the ultrasonic wall at a point associated with the raised portion 31*a* and a hollow portion 31*b* (as shown in further detail in FIG. 4A). In various embodiments, this means that the one or more arc-suppression walls 31 may operate as an additional alignment portion when the housing 15 is assembled from parts 15*a* and 15*b*, including during an ultrasonic welding process.

In various embodiments, the raised portion 31*a* and hollow portion 31*b* of the one or more arc-suppression walls 31 are adjacent to one another, and in one or more embodiments, the raised portion 31*a* and hollow portion 31*b* of the one or more arc-suppression walls 31 are adjacent to one another in the horizontal direction (linearly) as shown.

Figure 4B:
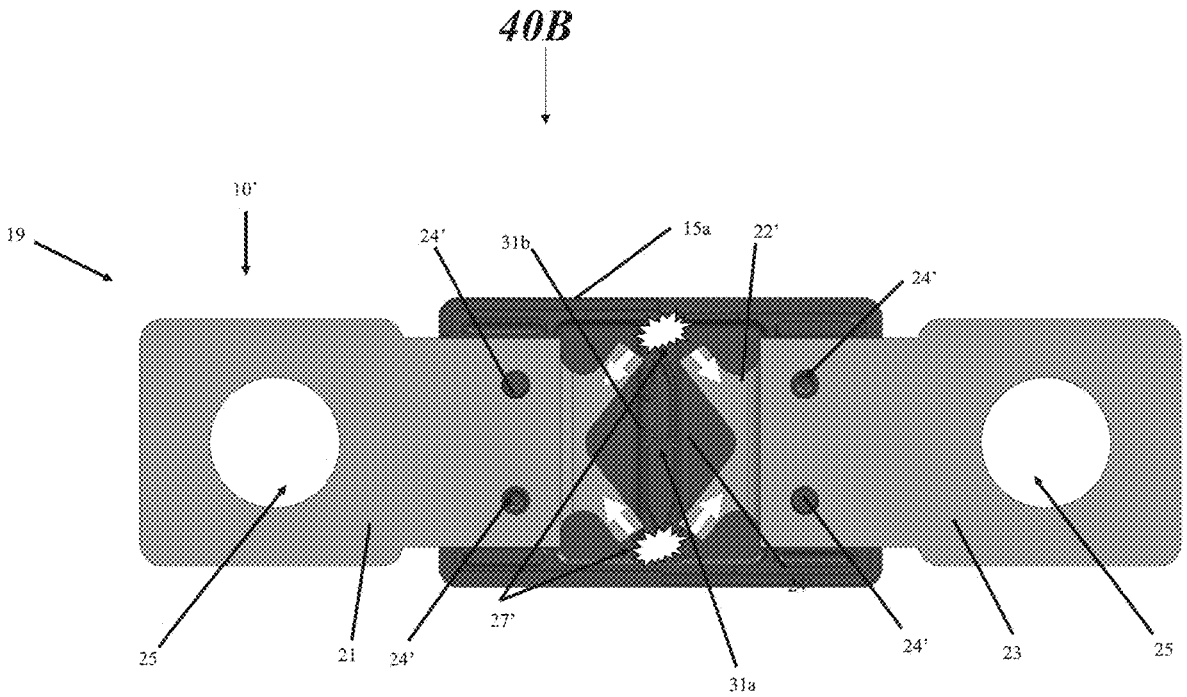

FIGS. 4A-4B illustrate an example of a fuse 10, from a lateral perspective, before and after the fuse element melts, in relation to part of the overall housing 15, e.g. housing part 15*a*, and according to various non-limiting embodiments of the present disclosure. In particular, FIG. 4A illustrates a configuration 40A of the fuse 10 before the fuse element 22 has melted while FIG. 4B illustrates a configuration 40B of the fuse 10, e.g. fuse 10', once the fuse element 22, e.g. fuse element 22', has melted. As depicted, and as described elsewhere herein, the one or more arc-suppression walls 31 are disposed in part of the interior cavity 11 of housing portion or part 15*a*, and above the fuse element 22 (although the configuration provides a lateral perspective for illustration purposes), where both the raised portion 31*b* and the hollow portion 31*a* may be paired to an arc-suppression wall of another housing part, e.g. 15*b*, with matching raised and hollow portions. In various embodiments, the fuse element 22 is contained in interior cavity 11 and makes contact with the one or more arc-suppression walls 31 on at least two points 27, where those two points correspond to the points where the fuse element 22 may melt during a fault condition, and also correspond to where the fuse element 22 contacts both the arc-suppression wall 31 and the interior cavity 11. The conductor 19 extends throughout the entirety of the housing part 15*a*, and is contained therein, with terminals 21 and 23 extending outside of the housing, and where containment holes 25 may be connected to an external source as described herein. Furthermore, in various embodiments, the one or more arc-suppression walls 31 are centered or aligned about the fuse element 22, and terminals 21, 23 extend out from the housing 15 and provide a path for current to flow through the fuse element 22. As shown alignment holes 24 are paired with the respective alignment portions corresponding to the housing part 15*a*, e.g. alignment portions 13, resulting in alignment holes 24' which may offer an enhanced bonding between housing part 15*a* and housing part 15*b*.

During normal operation of the fuse 10, current flows between the terminals 21, 23 through the fuse element 22. Upon the occurrence of a fault condition (e.g., an overcurrent condition), the fuse element 22 may melt or otherwise separate, resulting in a melted or blown fuse element 22' and gaps or separations 27', which interrupt connectivity of conductor 19, but where nonetheless an electrical arc may still propagate between the separated ends of the blown fuse element 22'. The electrical arc may heat and vaporize air and particulate matter in the vicinity of the blown fuse element 22', creating a small explosion within the fuse 10. The one or more arc-suppression walls 31 (individually and as a mated pair from each housing parts 15*a* and 15*b*) may absorb energy from the explosion and prevent the arc from being transmitted outside the fuse 10 and/or causing damage to the fuse 10 that would adversely affect other circuit elements connected thereto. In various embodiments, and as shown, arrows along the blown fuse element 22' indicate the direction in which the fuse element 22 is consumed by the arc. The arc goes from one side of the melting fuse element 22' opening point 27' to another opening point 27' and consumes the melting fuse element 22' material. Typically, the path of the arc is the shortest distance from one side to the other. In various embodiments, that would be a straight line parallel to the axis of the terminals 21 and 23 in the horizontal direction of the housing part 15*a*. As more material from the blown element 22' is consumed, the arc must pass through the one or more arc-suppression walls 31 in order to continue, which the arc cannot do because of the insulative properties of the material associated with the arc-suppression wall 31, e.g. the resistance of the arc path is greatly increased, and the arc is terminated much earlier than if it were allowed to propagate uninterrupted.

Although both FIG. 4A and FIG. 4B show a perspective with respect to one housing part 15*a*, it is understood that fuse may be contained in both housing parts 15*a* and 15*b* during operation, and the arc-suppression wall 31 of the overall housing 15 will include an arc-suppression wall 31 from both housing parts 15*a* and 15*b*, where the arc-suppression walls 31 are interconnected as indicated above.

FIGS. 2-4B illustrate one type of non-limiting configuration for one or more arc-suppression walls 31. Additional and alternative non-limiting configurations, as shown in FIG. 5A and FIG. 5B are also provided and discussed below.

Figure 5A:
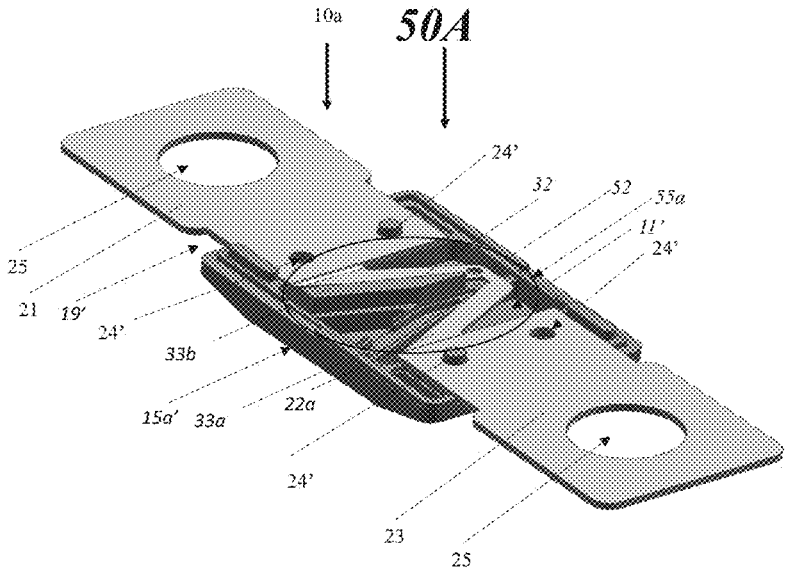
FIGS. 5A-5B are perspective views illustrating various alternative embodiments of the fuse of FIG. 1 in accordance with the present disclosure.
Figure 5B:
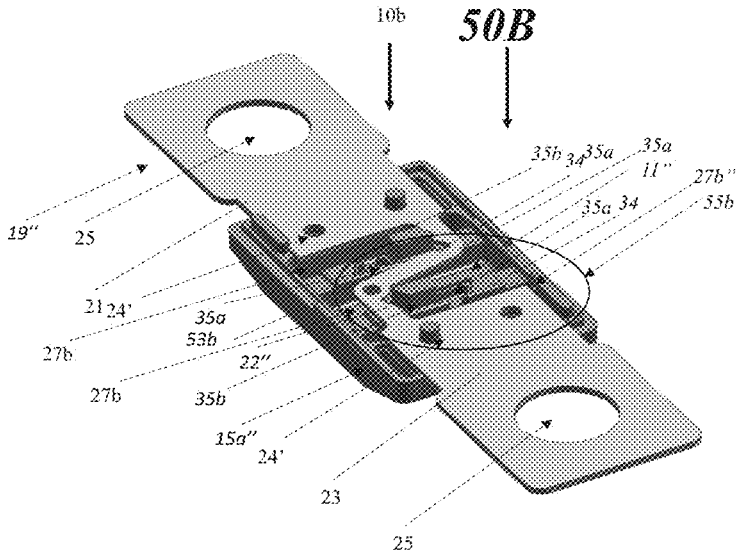

FIG. 5A illustrates a cross section 50A of a fuse 10*a* employing housing part 15*a'* and an angled arc-suppression wall 32 configuration 55 according to a non-limiting embodiment of the present disclosure. FIG. 5A shows a bottom (or top) part of the overall housing, e.g. housing part 15*a'*, where an opposed mating part (not expressly shown), may be aligned and ultrasonically bonded in accordance with the techniques discussed above with reference to FIGS. 1-4B, e.g. as housing parts 15*a* and 15*b* are bonded, and can contain the conductor 19'. In various embodiments, FIG. 5A provides a substantially similar overall configuration with respect to the conductor 19', terminals 21, 23, containment holes 25, alignment holes 24', housing part 15*a'*, and interior cavity 11, and the relationships therebetween, as provided for above with respect to FIG. 2 and FIG. 3, except that the area configuration 55*a* of fuse 10*a* is altered to provide for a different arc-suppression wall 32 and fuse element 22*a* configuration and connection therebetween, which includes an angled partitioning of interior cavity 11, as opposed to two distinct and roughly symmetrical portions 29 as shown in FIG. 2.

In various embodiments, one or more arc-suppression walls 32 are included in housing part 15*a'* (and a paired portion not shown), with a hollow portion 33*b* and a raised portion 33*a* forming an angle with respect to one another, with matching portions in the paired part. The arc-suppression wall 32 and the fuse element 22*a* are connected adjacent to one another, and in an angled configuration. In various embodiments, the arc-suppression wall 32 (of each housing part, e.g. 15*a*) is associated with the single point 52 such that a terminal point of the raised portion 33*a* and the hollow portion 33*b* of the arc-suppression wall 32 connect in relation to point 52 and correspond to a terminal boundary point of the interior cavity 11'. The angle between 33*a* and 33*b* allows for a vaporization area 55*b* to be defined with a single point 52, e.g. the fuse element 22*a* may vaporize at point 52.

In various embodiments, the single point 52 corresponds to the joining point of the raised portion 33*a* and hollow 33*b* as shown. The configuration of FIG. 5A offers an advantage during vaporization by reducing the proximity of points that may generate an arc after vaporization, in addition to providing the physical barrier associated with the arc-suppression walls 32. In various embodiments, the material associated with attached fuse element 22*a* may be reduced in comparison to fuse element 22, as a single point, e.g. 52, of connection requires less material to form fuse element 22*a*.

FIG. 5B illustrates a cross section 50B of a fuse 10*b* employing housing part 15*a*" and a dual arc-suppression wall 34 configuration 55*b* according to a non-limiting embodiment of the present disclosure. FIG. 5B shows a bottom (or top) part of the overall housing, e.g. housing part 15*a*", where an opposed mating portion (not expressly shown), may be aligned and ultrasonically bonded in accordance with the techniques discussed above with reference to FIGS. 1-5A, e.g. as housing parts 15*a* and 15*b* are bonded, and can contain the conductor 19". In various embodiments, FIG. 5B provides a substantially similar overall configuration with respect to the conductor 19", terminals 21, 23, containment holes 25, alignment holes 24', housing part 15*a*", and interior cavity 11", and the relationships therebetween, as provided for above with respect to FIGS. 2-4A, except that the area configuration 55*b* of fuse 10*b* is altered to provide for a different arc-suppression wall 34 and fuse element 22" configuration and connection therebetween, which includes at least two arc-suppression walls 34 contained in and defining the interior cavity 11" of the housing part 15*a*" into at least three portions, as opposed to two distinct and roughly symmetrical portions 29 as shown in FIG. 2 and/or a single angled configuration defining an asymmetrical space in the interior cavity 11' as shown in FIG. 5A.

In various embodiments, each housing part, e.g. 15*a*", includes two or more arc-suppression walls 34, where the arc-suppression walls 34 define an area 55*c* such that a raised portion 35*a* of each arc-suppression wall 34 is associated with a vaporization point 53*a* and 53*b* of fuse element 22", where fuse element wraps around a portion of the raised portion 35*b* of each arc-suppression wall 34 at points 53*a* and 53*b*. In one embodiment, as shown, for each housing part, e.g. 15*a*", the raised portion 35*a* of one of the two arc-suppression walls 34 is opposite to the hollow portion 35*b* of the other one of the two arc-suppression walls 34 in the same housing part 15*a*. The presence of two arc-suppression walls 34 in the same housing part 15*a* provides an advantage in that a physical barrier to arc-suppression exists at two or more potential points where the fuse element 22" may break or vaporize, which further inhibits the ability of an arc to exit an overall housing that includes two housing parts, e.g. 15*a*" and its paired mate, from exiting the overall housing. In one or more embodiments, as shown, the presence of two or more arc-suppression walls 34 divides the interior cavity of each housing part 15*a*" into at least three distinct parts or portions 27*b*.

Although one or more of the above examples and embodiments are directed to one or more arc-suppression walls that are bonded according to an ultrasonic technique, a different bonding scheme may be used with the materials disclosed and/or different materials, e.g. arc-suppression walls as described above may be configured as shown without using an ultrasonic bonding technique, e.g. any suitable technique for combining housing parts may be used, and for any suitable purpose, including to take advantage of the ability of the physical configurations as shown to suppress electrical arcs during fuse vaporization events.

As used herein, references to "an embodiment," "an implementation," "an example," and/or equivalents is not intended to be interpreted as excluding the existence of additional embodiments also incorporating the recited features.

While the present disclosure has been made with reference to certain embodiments, numerous modifications, alterations and changes to the described embodiments are possible without departing from the sphere and scope of the present embodiments, as defined in the appended claim(s). Accordingly, the present disclosure is not to be limited to the described embodiments, but rather has the full scope defined by the language of the following claims, and equivalents thereof.

What is claimed is:

1. A fuse, comprising:

a first housing part having an interior cavity and an outer cavity;

a fuse element disposed within the interior cavity;

a plurality of terminals extending out of the first housing part and electrically connected to the fuse element; and an arc-suppression wall disposed in the interior cavity, the arc-suppression wall including a raised portion and a hollow portion, wherein both the raised portion and the hollow portion are configured to i) suppress an electric arc associated with the fuse element opening and ii) facilitate ultrasonic bonding of the first housing part to a second housing part;

wherein the arc-suppression wall is oriented perpendicular to a long axis of the fuse element, and wherein the fuse element is split into a first portion that extends around a first side of the arc-suppression wall at an acute angle and a second portion that extends around a second side of the arc-suppression wall at an acute angle.

2. The fuse of claim 1, wherein the arc-suppression wall divides the interior cavity into at least two distinct portions.

3. The fuse of claim 1, wherein the second housing part includes i) a matched hollow portion and ii) a matched raised portion, wherein the matched hollow portion and the matched raised portion align with the raised portion and the hollow portion, respectively, to couple the first housing part and the second housing part to one another.

4. The fuse of claim 1, wherein the arc-suppression wall is configured to suppress the electric arc on at least two distinct points along the fuse.

5. The fuse of claim 4, wherein the raised portion and the hollow portion are adjacent to one another.

6. The fuse of claim 5, wherein the raised portion and the hollow portion are adjacent to one another in a horizontal direction.

7. The fuse of claim 1, wherein the arc-suppression wall is configured to suppress the electric arc at a single point along the fuse.

8. The fuse of claim 7, wherein a point of the raised portion and a point of the hollow portion join to form an angle.

9. The fuse of claim 8, wherein a joining point of the raised portion and the hollow portion corresponds to the single point along the fuse.

10. A fuse, comprising:

a first housing part having an interior cavity and at least one outer cavity;

a fuse element disposed within the interior cavity;

a plurality of terminals extending out of the first housing part and electrically connected to the fuse element; and at least two arc-suppression walls disposed in the interior cavity, each of the arc-suppression walls including a raised portion and a hollow portion, wherein both the raised portion and the hollow portion are configured to i) suppress an electric arc associated with the fuse element opening and ii) facilitate ultrasonic bonding of the first housing part to a second housing part;

wherein the at least two arc-suppression walls are oriented perpendicular to a long axis of the fuse element, and wherein the fuse element is split into a first portion that extends around a first side of the arc-suppression walls at an acute angle and a second portion that extends around a second side of the arc-suppressions wall at an acute angle.

11. The fuse of claim 10, wherein the raised portion of one of the at least two arc-suppression walls aligns in an opposite direction to the hollow portion of another one of the at least two arc-suppression walls, and wherein the hollow portion of the one of the at least two arc-suppression walls aligns in an opposite direction to the raised portion of another one of the at least two arc-suppression walls.

12. The fuse of claim 10, wherein the at least two arc-suppression walls divide the interior cavity into at least three distinct portions.

13. The fuse of claim 12, wherein the raised portions of each of the at least two arc-suppression walls are configured to suppress the electric arc on at least one point along the fuse.

14. The fuse of claim 10, wherein the raised portion and the hollow portion of each of the at least two arc-suppression walls are adjacent to one another.

15. The fuse of claim 14, wherein the raised portion and the hollow portion of each of the at least two arc-suppression walls are adjacent to one another in a horizontal direction.

16. A method of forming a fuse, comprising:

providing a fuse structure comprising a fuse element and a first terminal and a second terminal connected to the fuse element;

providing a first housing part and a second housing part, each of the first housing part and the second housing part including at least one arc-suppression wall; and bonding the first housing part and the second housing part by ultrasonically bonding the at least one arc-suppression wall of the first housing part to the arc-suppression wall of the second housing part;

wherein the arc-suppression walls are oriented perpendicular to a long axis of the fuse element, and wherein the fuse element is split into a first portion that extends around a first side of the arc-suppression walls at an acute angle and a second portion that extends around a second side of the arc-suppressions wall at an acute angle.

17. The method of claim 16, wherein the at least one arc-suppression wall of both the first housing part and the second housing part include a raised portion and a hollow portion, and wherein the bonding of the first housing part and the second housing part comprises:

aligning the raised portion of the at least one arc-suppression wall of the first housing part with the hollow portion of the at least one arc-suppression wall of the second housing part;

aligning the hollow portion of the at least one arc-suppression wall of the first housing part with the raised portion of the at least one arc-suppression wall of the second housing part; and after aligning the first housing part and the second housing part, ultrasonically bonding the at least one arc-suppression wall of the first housing part to the arc-suppression wall of the second housing part.

18. The method of claim 17, wherein both of the raised portion and the hollow portion of each of the at least one arc-suppression walls of both the first housing part and the second housing part are configured to suppress an electric arc associated with the fuse element opening.

19. The method of claim 18, wherein the raised portion and the hollow portion of the each of the at least one arc-suppression wall of both the first housing part and the second housing part are adjacent to one another.

20. The method of claim 18, wherein the raised portion and the hollow portion of the each of the at least one arc-suppression walls of both the first housing part and the second housing part are adjacent to one another in a horizontal direction.

* * * * *